US010145062B2

(12) United States Patent
De Vries

(10) Patent No.: US 10,145,062 B2
(45) Date of Patent: Dec. 4, 2018

(54) METHODS OF MANUFACTURING DAMPENING LAYERS

(71) Applicant: Ten Cate Nederland B.V., Almelo (NL)

(72) Inventor: Hugo De Vries, Ridderkerk (NL)

(73) Assignee: Ten Cate Thiolon B.V., Nijverdal (NL)

( * ) Notice: Subject to any disclaimer, the term of this patent is extended or adjusted under 35 U.S.C. 154(b) by 416 days.

(21) Appl. No.: 14/651,897

(22) PCT Filed: Dec. 13, 2013

(86) PCT No.: PCT/NL2013/050901

§ 371 (c)(1),
(2) Date: Jul. 30, 2015

(87) PCT Pub. No.: WO2014/092577

PCT Pub. Date: Jun. 19, 2014

(65) Prior Publication Data

US 2015/0345075 A1 Dec. 3, 2015

(30) Foreign Application Priority Data

Dec. 13, 2012 (NL) ..... 1039954

(51) Int. Cl.
*B29C 44/12* (2006.01)
*B29C 44/32* (2006.01)
*D05C 17/02* (2006.01)
(Continued)

(52) U.S. Cl.
CPC ..... *D06N 7/0081* (2013.01); *D02G 3/445* (2013.01); *D03D 1/0017* (2013.01);
(Continued)

(58) Field of Classification Search
CPC ..... B29C 44/12; B29C 44/32; D02G 3/02; D02G 3/04; D02G 3/445; D03D 1/0017;
(Continued)

(56) References Cited

U.S. PATENT DOCUMENTS 3,100,926 A 8/1963 Richmond
3,694,873 A 10/1972 Crowley
(Continued)

FOREIGN PATENT DOCUMENTS

CA 889668 A 1/1972
DE 2730915 A1 1/1979
(Continued)

OTHER PUBLICATIONS

International Preliminary Report on Patentability dated Feb. 9, 2015 for Application No. PCT/NL2013/050901.
Written Opinion for International Patent Application No. PCT/NL2015/050419, International Filing Date: Jun. 10, 2015, dated May 19, 2016, 7 pgs.

*Primary Examiner* — Leo B Tentoni
(74) *Attorney, Agent, or Firm* — N.V. Nederlandsch Octrooibureau; Catherine A. Shultz; Lindsey A. Auerbach

(57) ABSTRACT

A damping layer comprises a large number of yarns combined to form a textile, wherein at least some of the yarns are foamed synthetic yarns. Such a textile, which consists of a mix of foamed and non-foamed synthetic yarns, is relatively strong and light and can lead to more efficient use of the foamed material. The foamed synthetic yarn may be formed into upstanding loops which provide additional resiliency and damping.

8 Claims, 5 Drawing Sheets

Figure 1:
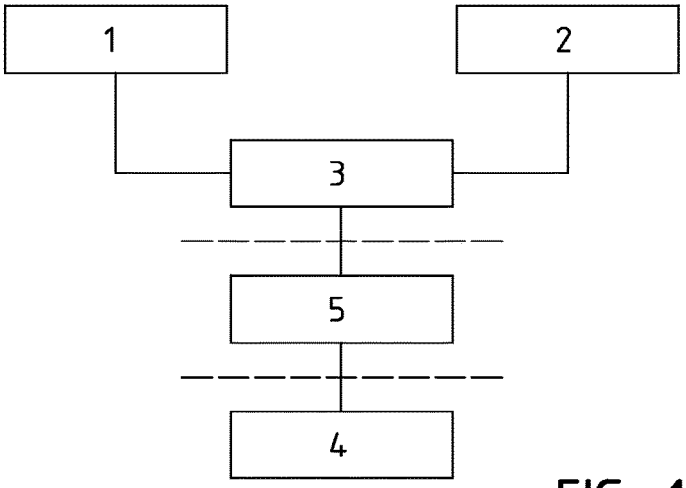

(51) Int. Cl.

| | |
|---|---|
| ***D06N 7/00*** | (2006.01) |
| ***D03D 1/00*** | (2006.01) |
| ***D02G 3/44*** | (2006.01) |
| ***D03D 15/00*** | (2006.01) |
| *A47G 27/04* | (2006.01) |

(52) U.S. Cl.
CPC ..... *D03D 1/0029* (2013.01); *D03D 15/00* (2013.01); *D05C 17/023* (2013.01); *D06N 7/0065* (2013.01); *D06N 7/0068* (2013.01); *D06N 7/0071* (2013.01); *D06N 7/0086* (2013.01); *D06N 7/0089* (2013.01); *A47G 27/0468* (2013.01); *D06N 2201/0254* (2013.01); *D06N 2205/04* (2013.01); *D10B 2401/08* (2013.01); *D10B 2503/04* (2013.01)

(58) Field of Classification Search
CPC .... D03D 1/0029; D03D 1/0064; D05C 17/02; D05C 17/023; D06N 7/0065; D06N 7/0068; D06N 7/0071; D06N 7/0081; D06N 7/0086; D06N 7/0089
USPC ..... 264/45.1, 46.4, 103; 28/159
See application file for complete search history.

(56) References Cited

U.S. PATENT DOCUMENTS

| | | | | |
|---|---|---|---|---|
| 4,186,068 | A | 1/1980 | Rubens | |
| 4,482,595 | A | 11/1984 | Fujishita et al. | |
| 5,654,065 | A * | 8/1997 | Kishi ..... | D06N 7/0089 428/86 |
| 6,007,911 | A | 12/1999 | Bowen, Jr. | |
| 6,221,486 | B1 | 4/2001 | Soane et al. | |
| 2006/0213234 | A1 | 9/2006 | Gladfelter et al. | |
| 2008/0099096 | A1 | 5/2008 | Kania et al. | |
| 2010/0021660 | A1 | 1/2010 | Slootweg et al. | |

FOREIGN PATENT DOCUMENTS

| | | | |
|---|---|---|---|
| GB | 799609 | A | 8/1958 |
| GB | 977513 | A | 12/1964 |
| GB | 1013957 | A | 12/1965 |
| GB | 1229671 | A | 4/1971 |
| GB | 1229672 | A | 4/1971 |
| NL | 6615417 | A | 2/1967 |

* cited by examiner

METHODS OF MANUFACTURING DAMPENING LAYERS

This application is a U.S. national phase application filed pursuant to 35 U.S.C. § 371 and claims benefit of PCT Patent Application No. PCT/NL2013/050901, filed Dec. 13, 2013, and Netherlands Patent Application No. 1039954, filed Dec. 13, 2012.

The invention relates to a method for forming a damping layer. Many variants of such damping layers are known and these are often used as an underlay, for example under a carpet. The known damping layers are often made of plastic foam, which is available in the form of panels, tiles or strips on a roll. Using a damping layer under a carpet increases user comfort. In addition, such a layer often has an insulating effect, both thermally and acoustically, which is also pleasant for a user. If a damping layer is used under an artificial turf pitch, the properties of the artificial turf pitch formed in this way can be improved.

Existing damping layers which are formed using monolithic plastic foam have the drawback that they are relatively bulky. In addition, the mechanical properties of plastic foam, in particular the tensile strength, are moderate. Thus, cracking may occur rather quickly as a result of the foam being subjected to load, leading to local loss of the damping action.

It would be desirable to provide an alternative method for forming a damping layer.

According to the invention, a large number of yarns are combined to form a textile, wherein at least some of the yarns are foamed synthetic yarns. Such a textile, which thus partly also consists of yarns other than foamed synthetic yarns, is relatively strong and light and can lead to more efficient use of the foamed material.

In a preferred embodiment of the invention, the yarns are first connected to each other, and subsequently at least some of the synthetic yarns are foamed. Thus, the textile can be formed using conventional means, since the synthetic yarns can be handled more easily before than after foaming. In addition, the textile can be transported in a simple manner as long as the synthetic yarns have not been foamed, as the volume is then still relatively small.

Preferably, the yarns are connected to each other by means of weaving. A woven fabric is relatively light and strong, and can be constructed to have good properties in different directions.

If the synthetic yarns to be foamed are incorporated into the textile in the form of plastic strips, a large amount of plastic foam can be created in a relatively simple way. In particular, the material to be foamed may be supplied from a roll and may be cut into strips prior to entering said weaving machine and being woven into the fabric. In the present context reference to a strip is intended to denote a flat tape-like structure having a width greater than its thickness. It will be understood that this may refer to the unfoamed state and that once foamed, the strips may adopt another shape.

In one embodiment, in order to provide strength in the direction of the foamed synthetic yarns, at least one yarn which is not to be foamed may preferably be arranged between adjacent synthetic yarns to be foamed.

In a further embodiment sufficient yarns which are not to be foamed may be arranged between adjacent foamable synthetic yarns that the adjacent foamable synthetic yarns contact each other after foaming. In this manner, additional bonds may be created in the plastic foam between the adjacent foamed synthetic yarns. As a result thereof, the resulting damping layer is better able to withstand load, since the adjacent foamed synthetic yarns are able to support against each other and may even be connected together.

In a most preferred embodiment, the synthetic yarns to be foamed can be interwoven as warp threads with weft threads of yarns which are not to be foamed, and each warp thread to be foamed can in each case grip and/or drop several weft threads which are not to be foamed. Thus, relatively large loops of plastic foam are formed in the fabric. As a result of their arched shape, the plastic foam loops can offer a very high degree of elasticity and/or damping. Not only do they provide damping by virtue of their material properties in compression, they also provide damping as a result of their shape i.e. due to bending forces in the arch or loop. In the present context, reference to loops is intended to refer to arches of foamed material upstanding from the fabric. Most preferably, the loops of foamed synthetic yarn are open arches i.e. forming an opening under the arch or otherwise having a space between the loop and the remainder of the fabric. Such a structure may be particularly advantageous in terms of water-draining properties or the like.

If each warp thread to be foamed in each case grips a different number of weft threads which are not to be foamed than it drops, differently sized loops are produced on either side of the textile. Thus, for example, relatively small loops can be formed on the bottom side of the textile, so that the textile can be placed on a surface in a stable manner, while the loops on the top side of the textile may be larger in order to provide better elasticity and/or damping.

The synthetic yarns to be foamed may preferably comprise polyethylene or polypropylene. These are plastics which can readily be foamed, but which, in addition, can readily be reused at the end of the service life of the layer.

The synthetic yarns can easily be foamed by heating them to a temperature of at least 100° C., preferably at least 150° C. and more preferably in the order of magnitude 200° C.

Preferably, some of the foamed synthetic yarns or of the synthetic yarns to be foamed have properties which differ from those of the other foamed synthetic yarns or synthetic yarns to be foamed. In this way, the characteristics of the layer can be varied or adjusted across its surface, depending on the expected use.

The invention also relates to a textile which may be produced by any of the above-described methods. To this end, the invention provides a damping layer which comprises a textile which is formed by a large number of interconnected yarns, wherein at least some of the yarns are foamed synthetic yarns. Compared to a conventional layer of this type, such a damping layer has the advantages which have been described above. Preferably, there is provided a textile comprising loops of foamed synthetic yarn upstanding from the textile. It will be understood that although reference is given to a damping layer, the layer will also have resilient properties. The degree of damping or resilience of the layer will depend on the nature of the foamed synthetic yarns and their structure and also on the other components of the layer.

In a particularly preferred embodiment, loops of adjacent foamed synthetic yarns may engage against each other, providing additional support and may even bond to each other during the foaming process.

The invention also relates to the use of a damping layer of the above-described kind. According to one aspect of the invention, the damping layer is used as an underlay between a hard surface and a carpet. As a result thereof, a comfortable floor covering is formed. In this case, the damping layer may be provided without pile or upstanding fibres apart from the foamable fibres.

In one such embodiment, the carpet may advantageously be an artificial turf pitch. By using the claimed damping layer beneath an artificial turf pitch, the artificial turf pitch formed in this way can be played on more advantageously.

For certain applications, it may be advantageous if the damping layer is attached to the underside of the carpet as a backing.

According to another aspect of the invention, the damping layer can be used as a substrate for tufting a carpet or pitch. In this case therefore, yarns which are to form the piles of the carpet or the blades of an artificial turf pitch may be attached in openings or spaces in the damping layer by means of tuft needles. The blades or pile may then be upstanding between and beyond the upstanding loops formed by the foamed synthetic yarns.

Figure 2:
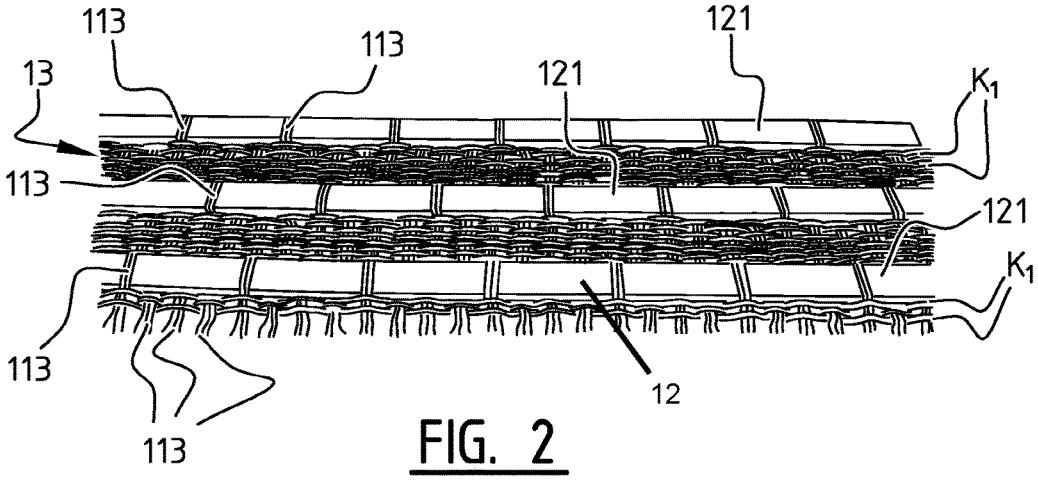
Figure 3:
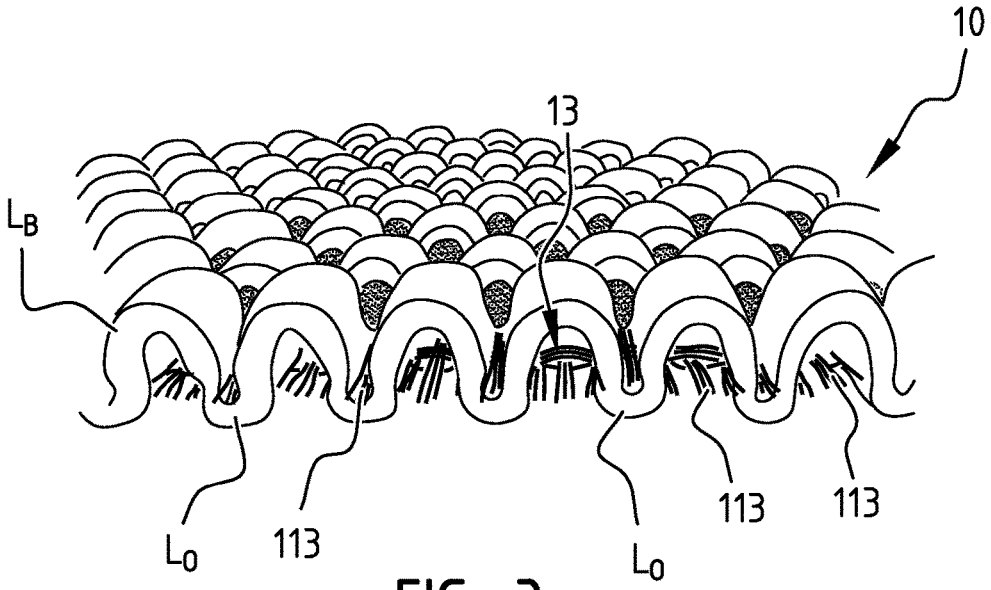
Figure 4:
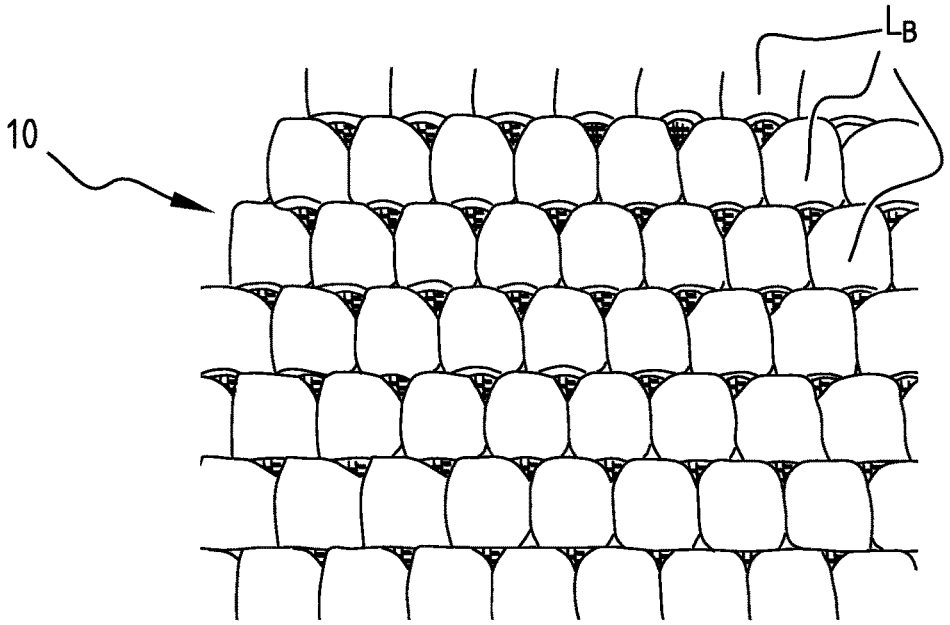
Figure 5:
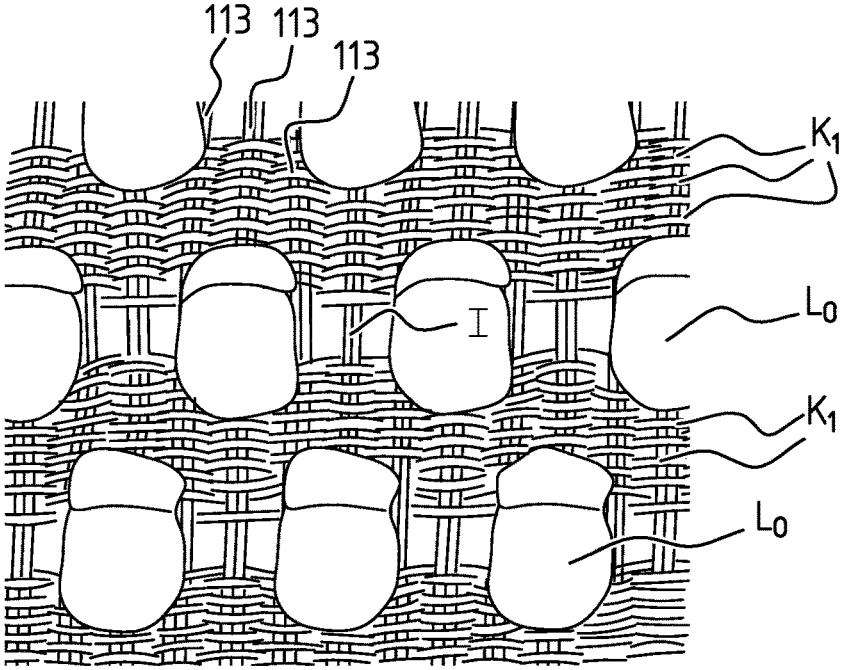
Figure 6:
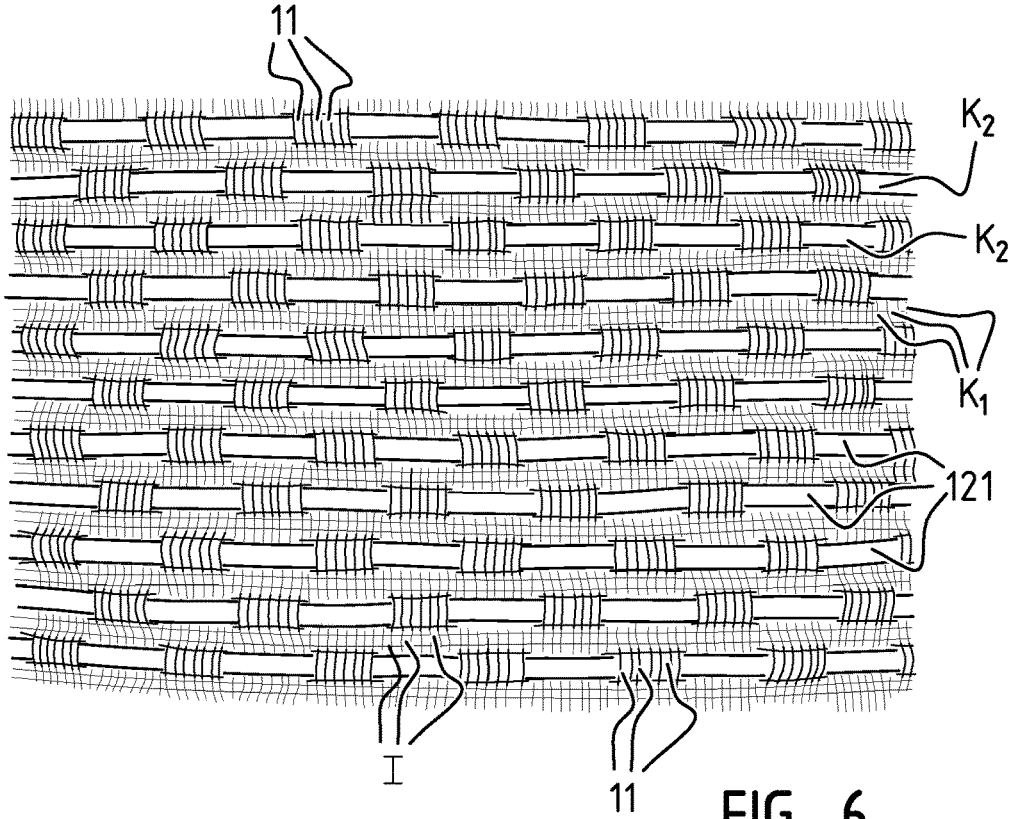
Figure 7:
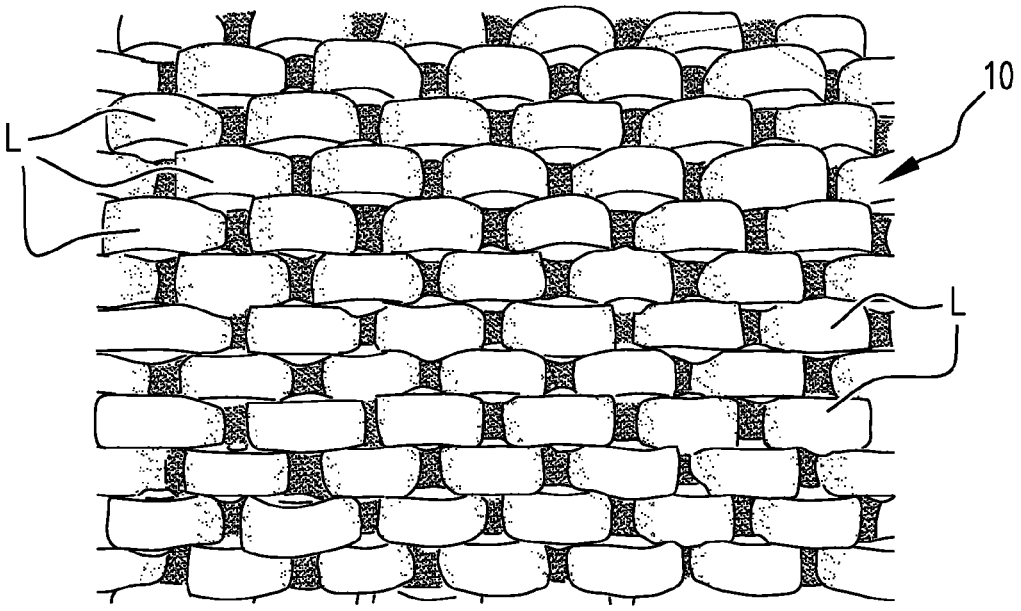
Figure 8:
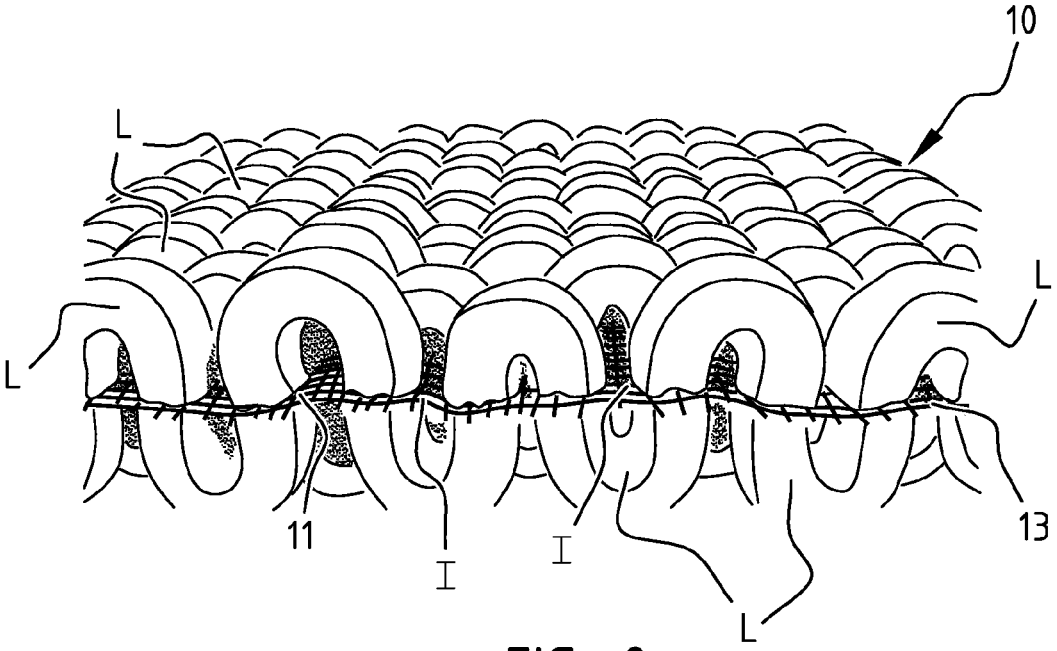
Figure 9:
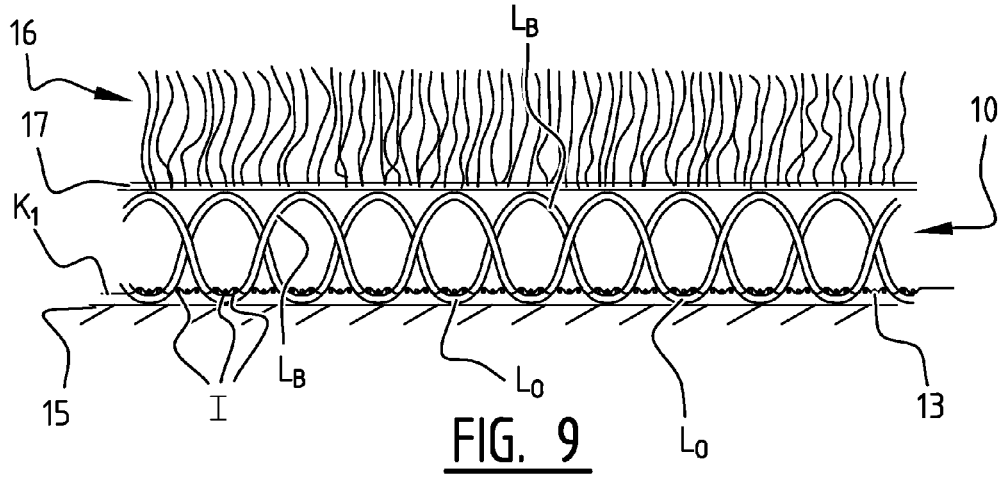
Figure 10:
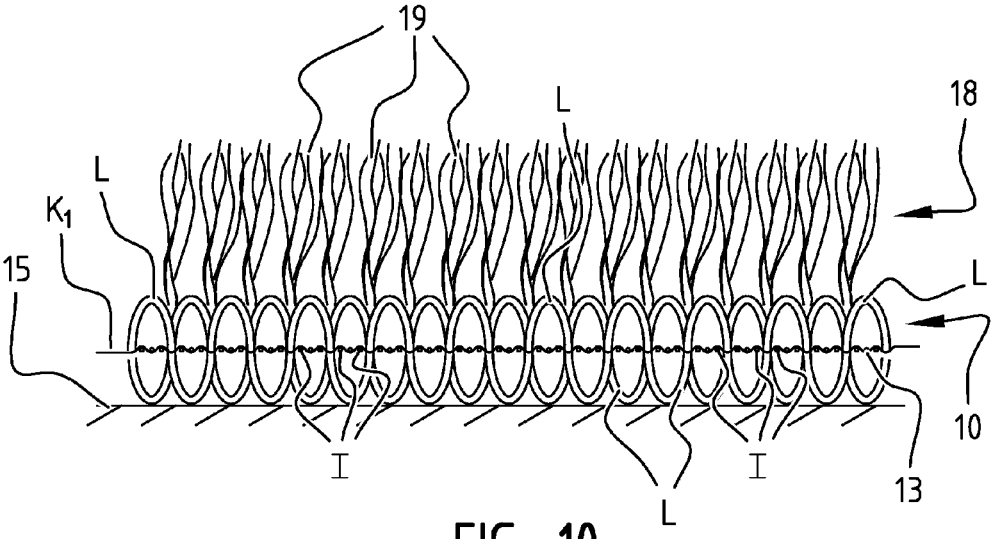

The invention will now be explained by means of a number of examples and with reference to the attached drawing, in which:

FIG. 1 shows a diagram of the stages of the method according to the invention, FIG. 2 shows a perspective view of a woven fabric comprising strips of plastic to be foamed which have been woven into the former as warp threads according to a first embodiment of the invention, FIG. 3 shows a perspective view of the fabric from FIG. 2 after the plastic strips have been foamed, FIG. 4 shows a top view of the fabric from FIGS. 2 and 3 after foaming, FIG. 5 shows a bottom view of said fabric after foaming, FIG. 6 shows a top view of another embodiment of a woven fabric comprising thin plastic strips to be foamed, FIG. 7 shows a view corresponding to that of FIG. 6 after foaming, FIG. 8 shows a perspective view of the fabric from FIGS. 6 and 7, FIG. 9 shows a diagrammatic cross section through the fabric from FIGS. 2-5 when used between a carpet and a hard surface, and FIG. 10 shows a view corresponding to that from FIG. 9 of the fabric from FIGS. 6-8 when used as a substrate.

A method for forming a damping layer 10 according to an embodiment of the invention comprises the stages of supplying a first set of (synthetic) yarns 11 (box 1) and supplying a second set of synthetic yarns 12 (box 2). In this case, the synthetic yarns 12 of the second set are suitable for foaming. For the material for these synthetic yarns 12, consideration may be given to polypropylene or polyethylene. Suitable materials for the yarns 11 which are not to be foamed are not only polypropylene, but for example also jute, polyester, fibreglass, cotton and cellulose.

In a subsequent stage (box 3), the yarns 11 which are not to be foamed and the synthetic yarns 12 to be foamed are connected to each other to form a textile 13. This connecting may be effected, for example, by means of a weaving technique, in which case the weft threads I are formed by the yarns 11 not to be foamed and the synthetic yarns 12 to be foamed are fed through the former as warp threads K.

After the textile 13 has been formed, the synthetic yarns 12 to be foamed may indeed be foamed in a subsequent stage (box 4). This may be effected, for example, by heating these synthetic yarns 12 to a relatively high temperature, for example in the order of magnitude of 200° C. Of course, the yarns 11 not to be foamed have to be able to withstand such a high temperature, at which a foaming agent is activated in the synthetic yarns.

Foaming the synthetic yarns 12 to be foamed may take place at the location at which the textile 13 is woven, but it is also conceivable that the textile 13 with the synthetic yarns 12 which have not yet been foamed and which at that point in time do not yet occupy a significant amount of space, is first transported (box 5) to a final location of use. At this location, the synthetic yarns 12 to be foamed can then be foamed, for example again by heating.

In FIG. 2, an example of a woven fabric 13 can be seen where weft threads I of yarns 11 not to be foamed have been interwoven with a large number of warp threads K1, likewise of yarns 11 not to be foamed, and a smaller number of warp threads K2 of synthetic yarns 12 to be foamed. In this case, the latter warp threads K2 are in the form of strips of plastic 121 which are to be foamed. As can be seen in the figure, in each case several warp threads K1 of yarns 11 not to be foamed are arranged between two adjacent strips 121 of plastic to be foamed, as a result of which they are caused to contact each other after foaming, when the volume of the strips 121 is greatly increased, but they do not completely merge with one another. As a result thereof, a very open textile 13 is produced which has good water-draining properties. On the other hand, the textile 13 provides good stability, as the adjacent strips 121 are all connected to one another.

FIG. 2 furthermore shows that each strip 121 of plastic to be foamed in each case grips a triple weft thread 113 and then drops three triple weft threads 113. As a result of this difference in the number of weft threads gripped and the number dropped, loops $L_B$, $L_O$ of different dimensions are produced after foaming on either side of the fabric 13, as can be seen by comparing FIGS. 3, 4 and 5. As can also be seen from FIG. 3, the loops $L_B$ have the shape of upstanding open arches with openings formed between the loop and the remainder of the fabric 13.

In another embodiment of the invention, the strips 121 of the plastic to be foamed are interwoven in a completely regular pattern (FIG. 6). In this case, each strip 121, as a warp thread, in each case grips as many weft threads as it drops. As a result thereof, thirteen loops L of identical dimensions are created on either side of the textile after foaming (FIG. 8). In this embodiment, relatively narrow strips 121 are used, as a result of which the textile 13 produced after foaming has a relatively fine grid of loops L.

Although the strips to be foamed are evenly distributed across the textile in the illustrated examples, and are also made of the same material, both the distribution of the synthetic yarns to be foamed and their shape, type and characteristics may vary. The synthetic yarns can be extruded into various different shapes. Types of plastic of relatively high and relatively low density can be used. Thus, it is possible to form zones in the textile having different characteristics. Furthermore, the distribution and the characteristics of the yarns not to be foamed may also vary. Thus, at locations where the textile is expected to be subjected to significant loads, more yarns which are not to be foamed will be arranged, or yarns having a greater thickness or tensile strength. Additionally, while the above examples illustrate a woven fabric with loops of foamed material formed in the warp, the invention is not limited to such a configuration.

As mentioned above, the damping layer 10 which is formed by using the woven foam can be used as an underlay between a hard surface 15 and a carpet 16 (FIG. 9). In this case, the damping layer 10 could be attached to the underside 17 of the carpet 16 as backing, but the carpet 16 may also be laid separately on the damping layer 10. The carpet 16 may form a floor covering or, for example, an artificial turf pitch. The damping layer 10 could also be used underneath types of hard flooring, such as parquet or laminate.

The damping layer 10 may also be used in a different way for forming an artificial turf pitch 18. For example, synthetic fibres 19 in the form of artificial turf blades can be tufted into the openings of the textile 13 (FIG. 10).

Other possible applications of the damping layer 10 are, for example, drainage mats, air-permeable mats, yoga mats, beach mats, etc. Technical uses of such layers include roof coverings, wall coverings or even as partition walls which can be used separately, provided the foam used is sufficiently stiff.

Although the invention has been described above by means of an example, it will be clear that it is not limited thereto. Thus, it is also possible to incorporate a plastic which has already been prefoamed in the form of strips or yarns into the textile. As a result thereof, the additional stage of foaming the synthetic yarns after they have been connected to the textile is omitted. In this case, the foam may be supplied from a roll to a weaving machine and be cut into strips prior to entering said weaving machine which can then be woven into the fabric. Incidentally, the strips of material to be foamed may also be formed in this way. The method can then be carried out in a simpler way, although the resulting product is bulkier and therefore more difficult to transport than a textile comprising synthetic yarns which have not yet been foamed.

The scope of the invention is solely determined by the following claims.

The invention claimed is:

1. A method for forming a damping layer by weaving a large number of yarns to form a textile, wherein at least some of the yarns are foamable synthetic yarns, and the yarns are first woven to each other and subsequently at least some of the synthetic yarns are foamed to form loops of foamed synthetic yarn upstanding from the textile and the loops of foamed synthetic yarn are open arches with the loops of adjacent foamed synthetic yarns engaging against each other and wherein at least one non-foamable yarn is arranged between adjacent foamable synthetic yarns.

2. The method according to claim 1, wherein the synthetic yarns to be foamed are incorporated into the textile in the form of plastic strips.

3. The method according to claim 1, further comprising causing the loops of adjacent foamed synthetic yarns to bond to each other during or subsequent to foaming.

4. A method for forming a damping layer by weaving a large number of yarns to form a textile, wherein at least some of the yarns are foamable synthetic yarns, and the yarns are first woven to each other and subsequently at least some of the synthetic yarns are foamed to form loops of foamed synthetic yarn upstanding from the textile and the loops of foamed synthetic yarn are open arches with the loops of adjacent foamed synthetic yarns engaging against each other, wherein the synthetic yarns to be foamed are interwoven as warp threads with weft threads of yarns which are not to be foamed, and each warp thread to be foamed alternately grips and drops several weft threads which are not to be foamed.

5. The method according to claim 4, wherein each warp thread to be foamed alternately grips a different number of weft threads which are not to be foamed than it drops.

6. The method according to claim 1, wherein the foamable synthetic yarns comprise polyethylene or polypropylene.

7. The method according to claim 1, wherein the foamable synthetic yarns are foamed by heating them to a temperature of at least 150° C.

8. A method for forming a damping layer by weaving a large number of yarns to form a textile, wherein at least some of the yarns are foamable synthetic yarns, and the yarns are first woven to each other and subsequently at least some of the synthetic yarns are foamed to form loops of foamed synthetic yarn upstanding from the textile and the loops of foamed synthetic yarn are open arches with the loops of adjacent foamed synthetic yarns engaging against each other, wherein some of the foamable synthetic yarns have properties which differ from those of the other foamable synthetic yarns.

* * * * *